US008707576B2

(12) United States Patent
Lin

(10) Patent No.: US 8,707,576 B2
(45) Date of Patent: Apr. 29, 2014

(54) TABLEWARE STERILIZING AND DRYING APPARATUS

(75) Inventor: Wei-Cheng Lin, Taichung (TW)

(73) Assignee: Yang Yih Machinery Co., Ltd., Taichung (TW)

( * ) Notice: Subject to any disclaimer, the term of this patent is extended or adjusted under 35 U.S.C. 154(b) by 310 days.

(21) Appl. No.: 13/348,643

(22) Filed: Jan. 12, 2012

(65) Prior Publication Data

US 2012/0186095 A1 Jul. 26, 2012

(30) Foreign Application Priority Data

Jan. 21, 2011 (TW) ..... 100102289 A

(51) Int. Cl.
*F26B 19/00* (2006.01)

(52) U.S. Cl.
USPC ..... 34/58; 34/90; 34/201; 211/41.9; 248/124.2; 134/113

(58) Field of Classification Search
USPC ..... 34/58, 60, 70, 80, 90, 104, 105, 201, 34/210, 218; 134/48, 99, 107, 113; 211/41.9; 248/316.1, 124.1
See application file for complete search history.

(56) References Cited

U.S. PATENT DOCUMENTS 1,376,379 A * 4/1921 North ..... 204/222
2,376,627 A * 5/1945 Seiple ..... 134/163
2,543,993 A * 3/1951 Stanitz et al. ..... 134/141
2,929,565 A * 3/1960 Gibson ..... 239/220
4,578,880 A * 4/1986 Motev et al. ..... 34/105
5,562,113 A * 10/1996 Thompson et al. ..... 134/95.2
5,678,320 A * 10/1997 Thompson et al. ..... 34/58
7,556,231 B2 * 7/2009 Herbst et al. ..... 248/316.1
2003/0029053 A1 * 2/2003 Kishimoto et al. ..... 34/312
2003/0196346 A1 * 10/2003 Schmidt ..... 34/236
2005/0236345 A1 * 10/2005 Herbst et al. ..... 211/41.9
2006/0165837 A1 * 7/2006 Wood ..... 425/435
2007/0169370 A1 * 7/2007 Sukup ..... 34/166
2010/0126034 A1 * 5/2010 Caspers et al. ..... 34/218
2010/0224223 A1 * 9/2010 Kehl et al. ..... 134/56 D
2012/0186095 A1 * 7/2012 Lin ..... 34/60
2012/0190386 A1 * 7/2012 Anderson ..... 455/456.3
2012/0227276 A1 * 9/2012 Tinsley et al. ..... 34/282
2013/0319485 A1 * 12/2013 Blanchard et al. ..... 134/110

FOREIGN PATENT DOCUMENTS

JP 2005230323 A * 9/2005 ..... A47L 15/42

* cited by examiner

*Primary Examiner* — Steve M Gravini

(57) ABSTRACT

A tableware sterilizing and drying apparatus of the present invention includes a rotatable base plate, several frames, and a fixation wheel. The frames have rotatable members, which are revolved by rotation of the base plate, and rotated by engagement or contaction of the fixation wheel. Thus, the rotatable member is provided for tableware to be placed thereon. The tableware is then brought drying and sterilizing with flipping motion. Surface of the tableware can be fully dried and sterilized.

19 Claims, 9 Drawing Sheets

TABLEWARE STERILIZING AND DRYING APPARATUS

BACKGROUND OF THE INVENTION

1. Field of the Invention

The present invention relates to a tableware sterilizing and drying apparatus.

2. Description of the Prior Art

Conventional tableware dryer, as shown in TW Utility Model No. M366989, dries tableware by heating. The tableware is merely placed in the dryer without being flipped over. It is frequently only upper surface of the tableware is heated and dried. Other surfaces of the tableware may still be moistened, especially in that the tableware is stacked up. In addition, if another sterilizing device is provided in the dryer, the tableware can hardly be sterilized completely.

The present invention is, therefore, arisen to obviate or at least mitigate the above mentioned disadvantages.

SUMMARY OF THE INVENTION

The main object of the present invention is to provide a dryer trying drying full surface of the tableware.

To achieve the above and other objects, a tableware sterilizing and drying apparatus of the present invention includes a shell, a base plate, several frames, a fixation wheel, a baking device, and a power device.

The shell defines a chamber and an opening communicating with the chamber.

The base plate is rotatably disposed in the shell. The base plate is located in the chamber. The base plate is able to rotate about a main axis.

The frames are disposed on an annular periphery area of the base plate. The frames revolve about the main axis when the base plate rotates. Each of the frames comprises a rotatable member. The rotatable members are able to rotate about central axes thereof respectively. Each of the central axes is parallel to the main axis. Each of the rotatable members has a rotation wheel perpendicular to the central axis thereof.

The fixation wheel is mounted to the shell. The fixation wheel is perpendicular to the main axis. An annular periphery of the fixation wheel is formed with a smooth section and a driving section. The rotation wheels revolve about the periphery of the fixation wheel. The fixation wheel contacts the rotation wheels in a rolling manner when the rotation wheels move passing by the driving section. The fixation wheel is unable to drive the rotation wheels to rotate when the rotation wheels move passing by the smooth section. The smooth section faces the opening.

The baking device is mounted to the shell. The baking device is used for heating air and sending air into the chamber.

The power device is mounted to the shell. The power device is used for driving the base plate to rotate.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
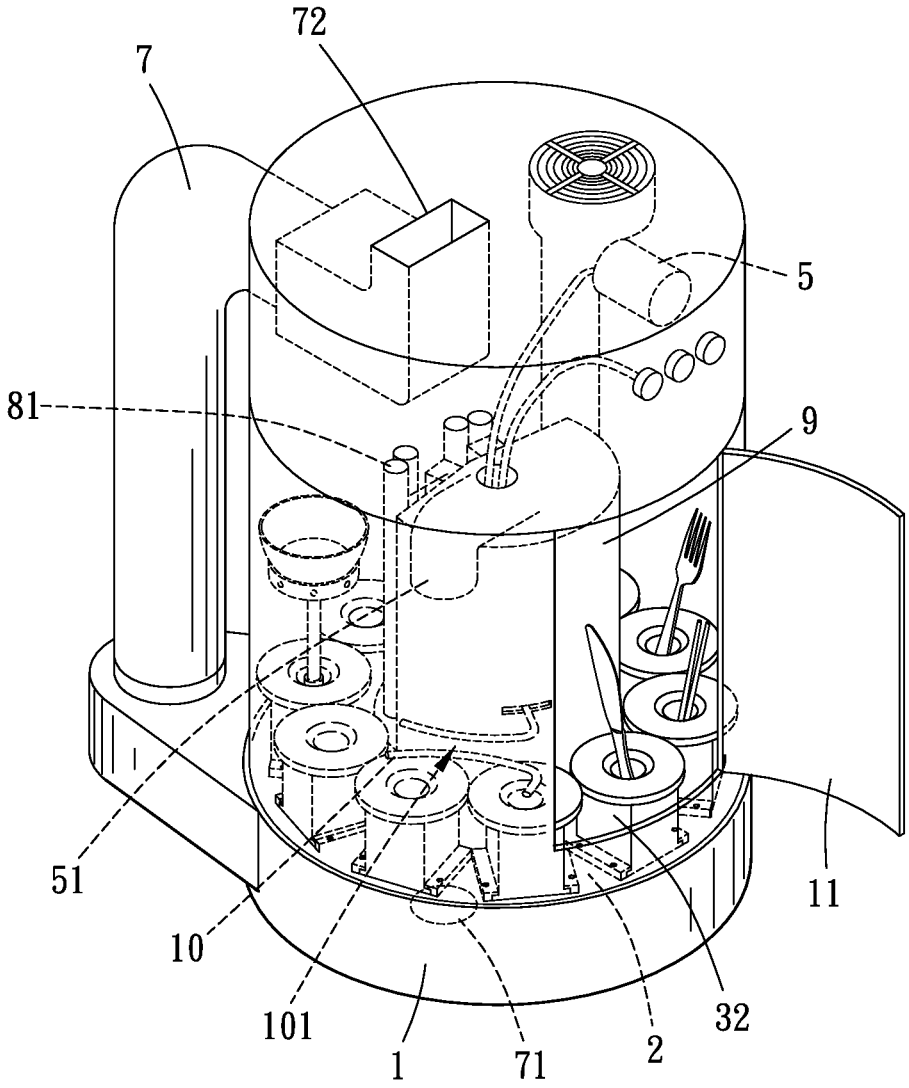
FIG. 1 is a stereogram showing a first embodiment of the present invention.

Please refer to FIGS. 1, 3, 4, and 5 for a first embodiment of the present invention. The tableware sterilizing and drying apparatus of the present embodiment includes a shell 1, a base plate 2, several frames, a fixation wheel 4, a baking device 5, and a power device. Preferably, the apparatus further includes an air extractor 7, a sterilizing device, a shelter 9, and two restraining rods 10.

Figure 2:
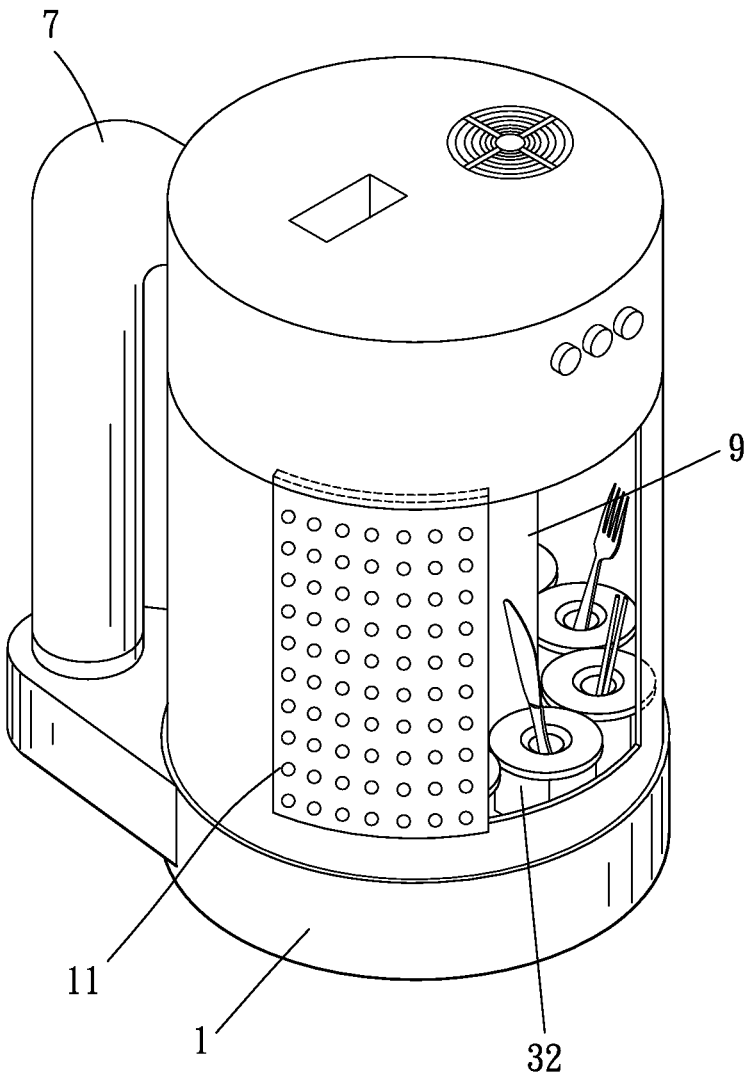
FIG. 2 is a stereogram showing a second embodiment of the present invention.
Figure 3:
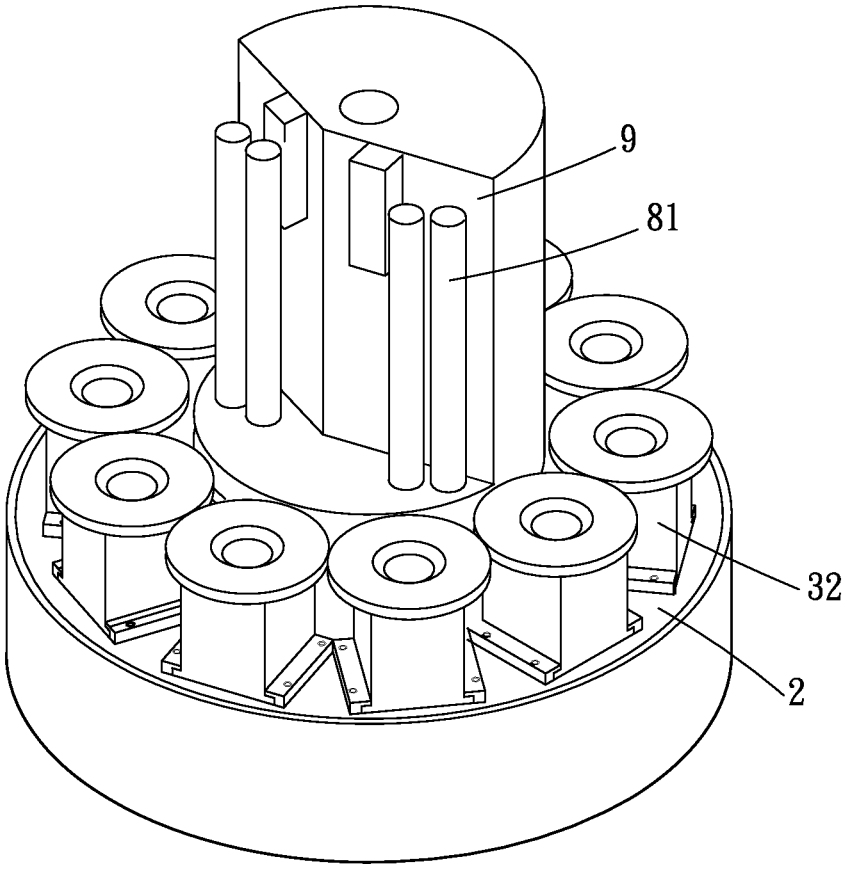
FIG. 3 is a stereogram showing partial components of a first embodiment of the present invention.
Figure 4:
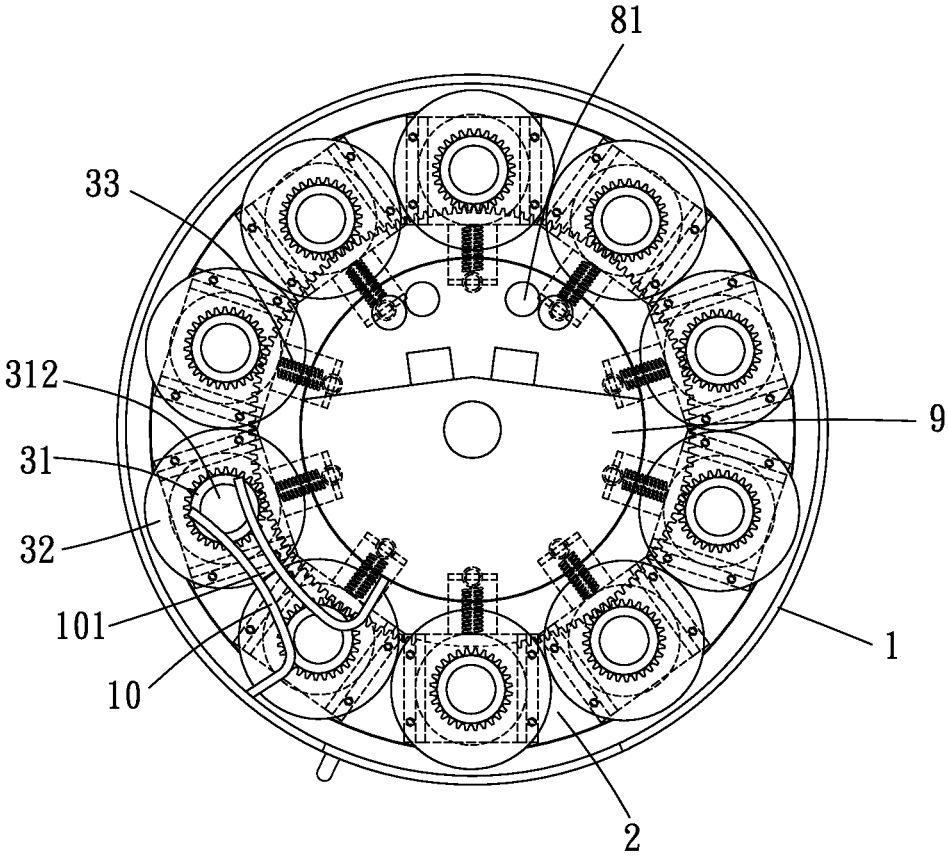
FIG. 4 is an overlooking drawing showing a first embodiment of the present invention.
Figure 5:
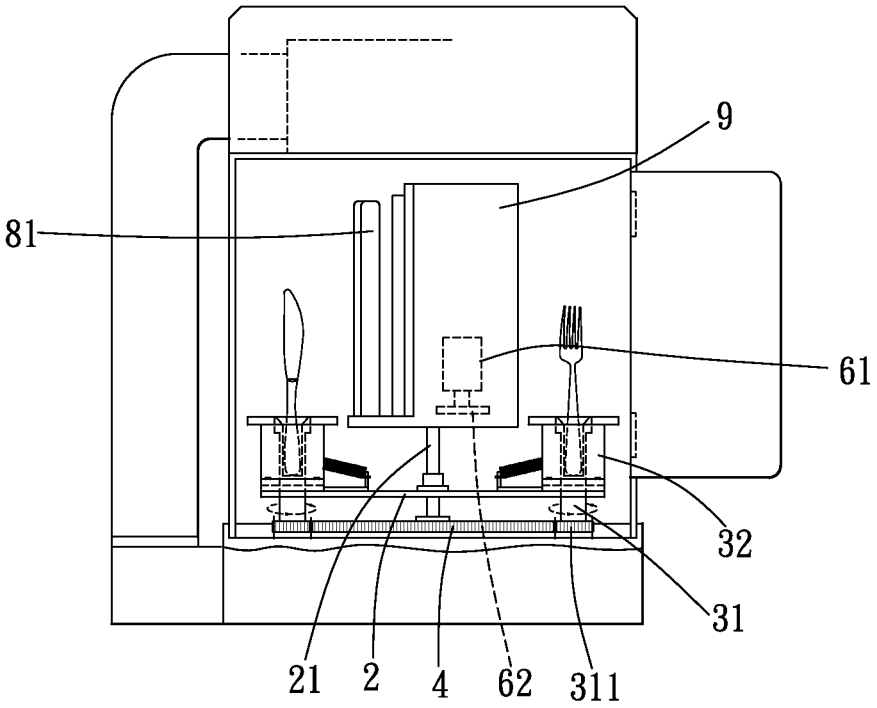
FIG. 5 is a side view showing a first embodiment of the present invention.

A chamber and an opening are defined by the shell 1. The opening communicates with the chamber. Preferably, the shell 1 includes a pivotable cover 11. The cover 11 swings to selectively cover the opening In a second embodiment of the present invention, as shown in FIG. 2, the cover 11 may be provided slidable, rather than pivotable. In addition, the cover 11 can be formed with several penetrations.

The base plate 2 is rotatably disposed in the shell 1, locating in the chamber. The base plate 2 is able to rotate about a main axis 21.

Figure 6:
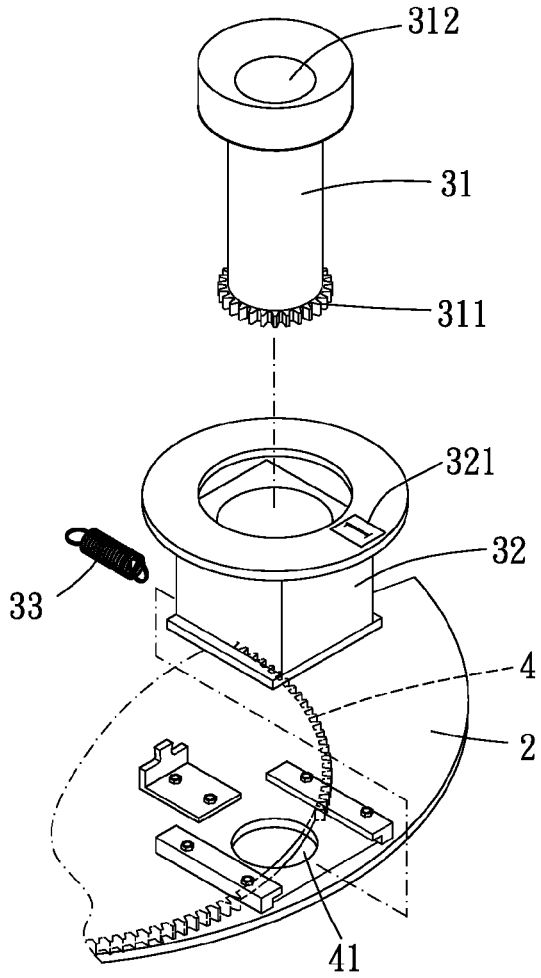
FIG. 6 is a breakdown drawing showing partial components of a first embodiment of the present invention.

The frames are disposed on an annular periphery area of the base plate 2. The frames are arranged about the main axis 21. When the base plate 2 rotates, the frames revolve about the main axis 21. Please refer to FIG. 6, each of the frames includes a rotatable member 31, a holder 32 and an elastic member 33. The holder 32 is slidably disposed on the base plate 2, and is able to slide along a radial direction of the base plate 2. The holder 32 is able to slide between a first position and a second position. The second position is located away form the main axis 21 with respect to the first position. In other words, the first position is located between the main axis 21 and the second position. Additionally, tag layer 321 is disposed on the holder 32. The lag layer 321 is printed or carved with figures, words, patterns, or numbers for recognition purpose. The elastic member 33 exerts an elastic force to the holder 32, making the holder 32 generally locating at the first position. More particularly, the elastic member 33 is pre-extended and attached to the holder 32 and the base plate 2. Alternatively, the elastic member 33 may be pre-compressed, providing the elastic force by pushing. The rotatable member 31 is rotatably disposed on the holder 32. The rotatable member 31 is able to rotate about a central axis thereof. The central axis is parallel to the main axis 21 of the base plate 2. The rotatable member 31 has a rotation wheel 311 which is formed thereon. The rotation wheel 311 is perpendicular to the central axis of the rotatable member 31. The rotatable member 31 is formed with a vertical groove 312 which is provided for tableware to be placed therein. Preferably, the rotation wheel 311 is formed with several teeth on the periphery thereof.

The fixation wheel 4 is mounted to the shell 1. The fixation wheel 4 is perpendicular to the main axis 21. An annular periphery of the fixation wheel is formed with a smooth section 41 and a driving section. The driving section is formed with several teeth. The teeth of the driving section are engaged with the teeth of the rotation wheel 311 of the rotatable member 31. Thus, when the rotatable members 31 revolve about the main axis 21 and move passing by the driving section, the rotatable members 31 are driven to rotate by tooth engagement of the rotation wheels and the driving section of the fixation wheel 4. In other words, the fixation wheel 4 and the rotation wheels 311 contact in a rolling manner. The smooth section 41 is formed without tooth, and preferably faces the opening Thus, when the rotatable members 31 revolve about the main axis 21 and move passing by the smooth section 41, the rotatable members 31 are not driven to rotate by the fixation wheel 4. More particularly, periphery surface of the rotation wheel 311 slips through, or even does no contaction with surface of the smooth section 41. In other possible embodiments of the present invention, the teeth of rotation wheel 311 and driving section may be replaced by contacting surfaces which are capable of inducing rolling contaction or non-slip contaction.

It should be noted that though smooth section is formed without tooth, the rotatable members 31 may still contact with the smooth section 41 of the fixation wheel, and friction force may still exert on the rotatable members 31. Discontinuously rotation of the rotatable member 31 caused by such unstable friction force may still occur. However, this kind of rotation can be expelled easily by friction force between the rotatable members 31 and the holders 32. Therefore, the incertitude rotation mentioned is neglected and regarded as non-rotation in the application. Accordingly, the smooth section 41 is preferably polished or recessed.

The baking device 5 is mounted to the shell 1. The baking device 5 is used for heating air and sending air into the chamber. More particularly, the baking device 5 may include electrical heater and blower. The blower could suck the air surrounding into the device 5, sending the air passing by the electrical heater. The air is then heated by the electrical heater, and further sent into the chamber.

The power device is mounted to the shell 1. The power device is used for driving the base plate 2 to rotate. More particularly, the power device may include motor 61 and decelerator 62. The motor 61 is connected to the decelerator 62, driving the base plate 2 by connection of the decelerator 62.

The air extractor 7 is mounted to the shell 1. The air extractor 7 is used for drawing the air in the chamber out, releasing the air to the surrounding. Thus, temperature over rising of the chamber is prevented.

The sterilizing device includes an ultraviolet lamp 81. The ultraviolet lamp 81 is firmly disposed in the shell 1. The ultraviolet lamp 81 is located above the base plate 2. The frames are annularly arranged around the ultraviolet lamp 81. Preferably, the sterilizing device includes several ultraviolet lamps so as to enhance the sterilizing ability.

The shelter 9 is mounted to the shell 1. The shelter 9 covers the motor 61 and the decelerator 62. The shelter 9 is located between the ultraviolet lamp 81 and the opening, so that the ultraviolet provided by the lamp 81 is concealed by the shelter 9 from emitting out of the chamber via the opening.

The restraining rods 10 are mounted to the shelter 9 and the shell 1 respectively. A channel 101 is defined by the restraining rods 10. The channel 101 is located vertically above the rotatable members 31.

For safety purpose, micro switches or emergency switches may be disposed on frames, base plate 2, or shell 1, especially around the opening Serious injury or damage is then avoided when malfunction caused by improper operation occurs.

Accordingly, the apparatus can be powered by electricity. Switches can be provided to the baking device 5, the power device, and the sterilizing device respectively. The switches can be mounted to the shell 1. The air extractor 7 may be controlled by the same switch of the baking device 5, or be controlled by another individual switch.

Figure 7:
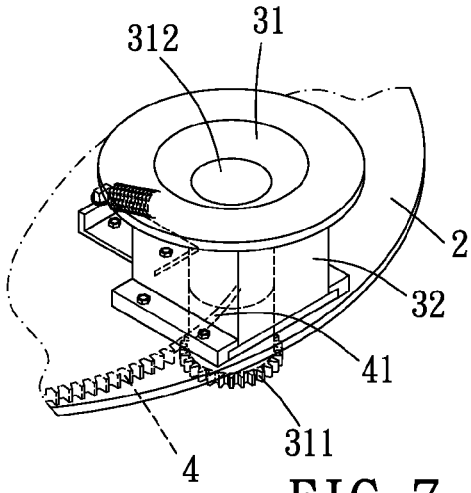
FIG. 7 is a stereogram showing partial components of a first embodiment of the present invention.
Figure 8:
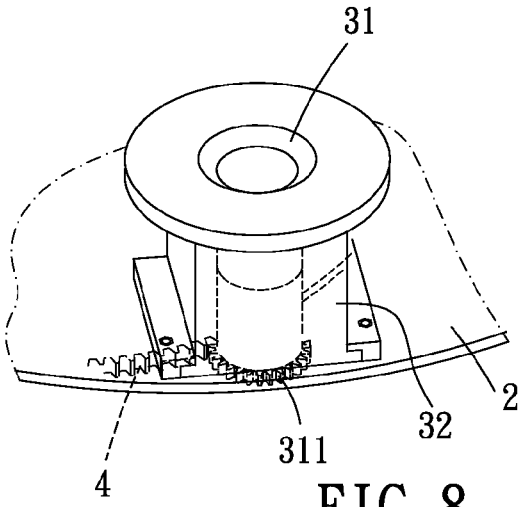
FIG. 8 is a schematic drawing showing a moving condition of a first embodiment of the present invention.
Figure 9:
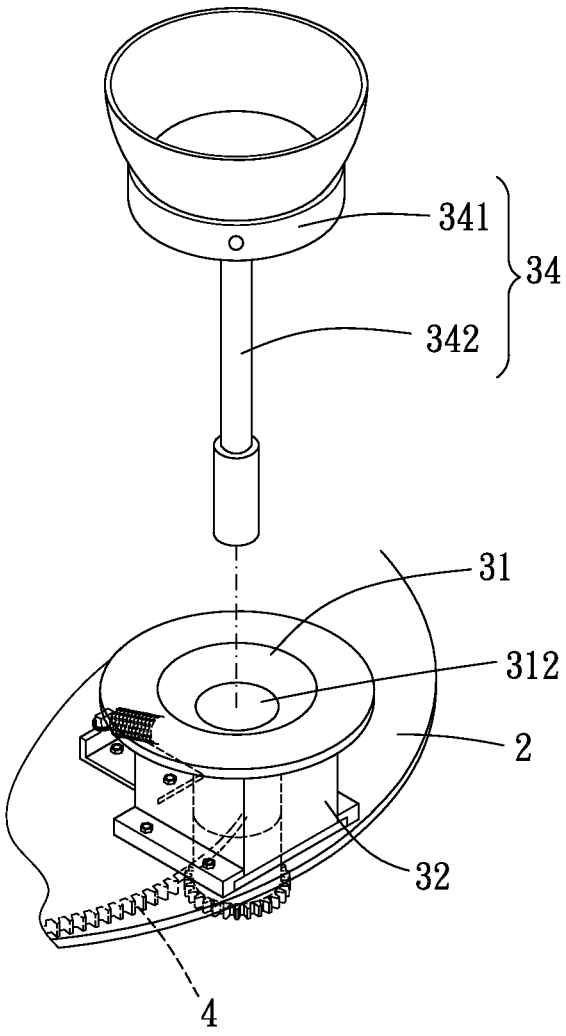
FIG. 9 is a schematic drawing showing an operation condition of a first embodiment of the present invention.

Firstly, the power device is switched on. Please refer to FIG. 7 and FIG. 8. The base plate 2 is rotated. The rotatable members 31 are revolved together with the base plate 2. By engagement of the rotation wheel 311 and the driving section of the fixation wheel 4, the rotatable members 31 are rolled and rotated.

When the rotatable members 31 revolves and moves passing by the opening and the smooth section 41, engagement of the rotation wheel 311 and the fixation wheel 4 is broken since the smooth section 41 is formed with no tooth. The rotatable members 31 are then only revolved without rotated. Thus, user can place tableware on the rotatable members 31 or in the vertical grooves 312. Preferably, handle end of the tableware is placed into the groove 312, so that the tapered end which contacts with food is exposed upwardly for drying and sterilizing. As the rotatable members 31 moving, the tableware is then moved pass through the channel 101 and pushed centralized to a predetermined position.

The baking device 5 and the air extractor 7 are switched on also. The baking device 5 heats and sends air into the chamber via an outlet 51. The air extractor 7 draws the air out of the chamber via an inlet. Thus, temperature of the chamber is raised. Preferably, the outlet 51 is located vertically above one of the rotatable members 31, so that the air is sent in and flows downwardly to the rotatable member 31 and the tableware. The inlet 71 of the air extractor 7 is located vertically under the outlet 51. Thus, an invisible high temperature channel is defined between the outlet 51 and the inlet 71. Tableware can be dried and sterilized well by passing through the high temperature channel. Therefore, temperature of the chamber is raised only partially so as to increase energy efficiency.

For safety purpose, outer surface or inner surface of the shell 1 may be further attached with heat insulation plate or similar material.

The sterilizing device is switched on also. Ultraviolet emitted by the ultraviolet lamp 81 is then irradiating the tableware around. Sterilization is achieved.

The vertical groove 312 is provided for knife, spoon, and chopsticks. For bowl and dish, a supporter 34 is provided. Lower end of the supporter 34 is formed with a rod 342 centrally and vertically extending therefrom. The rod 342 is inserted in the groove 312. Upper end of the supporter 34 is enlarged and formed with a position portion 341. The position portion 341 is provided for bowl or dish to be placed thereon.

The tag layer 321 on the holder is provided for recognition purpose. By obstruction of the shelter 9, user can not observe his/her tableware when drying and sterilizing. Thus, without the tag layer 321, user would probably take the wrong tableware after drying. By assistance of the tag layer 321, aspiration of user using the tableware sterilizing and drying apparatus would be promoted.

Figure 10:
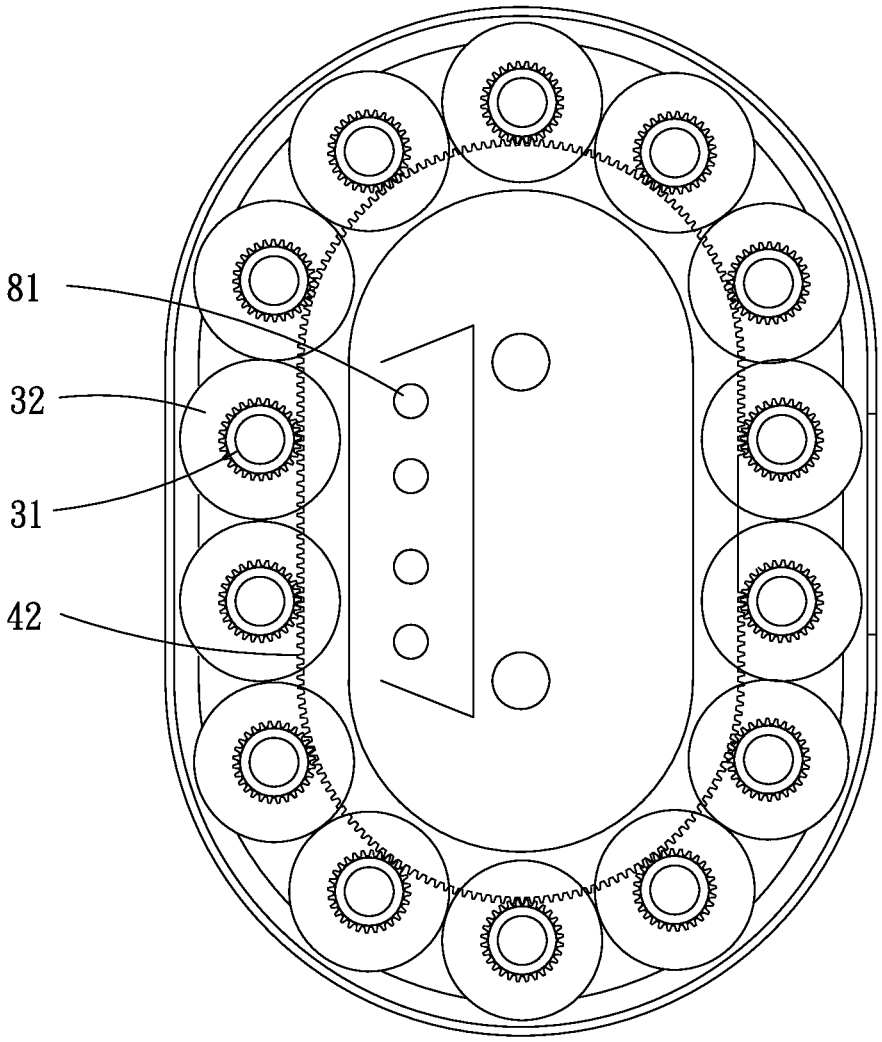
FIG. 10 is an overlooking drawing showing a third embodiment of the present invention.

In the present embodiment above, the frames are moved in a circular route. Please refer to FIG. 10. In a third embodiment of the present invention, the frames can be slidably disposed in a non-circular orbit, such as elliptical orbit. Naturally, another power device for moving the frames along the orbit, such as simplified rail vehicles, should be induced, providing the function of the base plate mentioned in the first embodiment. Also, in the non-circular orbit embodiment mentioned, appearance of the fixation plate should correspond to the orbit.

To conclude, tableware would be flipped over in drying and sterilizing process. Thus, outer surface of the tableware could be fully dried and sterilized. When user takes or places the tableware, flipping or rotating of the tableware is paused.

Additionally, the frames of the present embodiments are provided with elastic member and slidable holder. Obstruction caused by tooth engagement is prevented.

Figure 11:
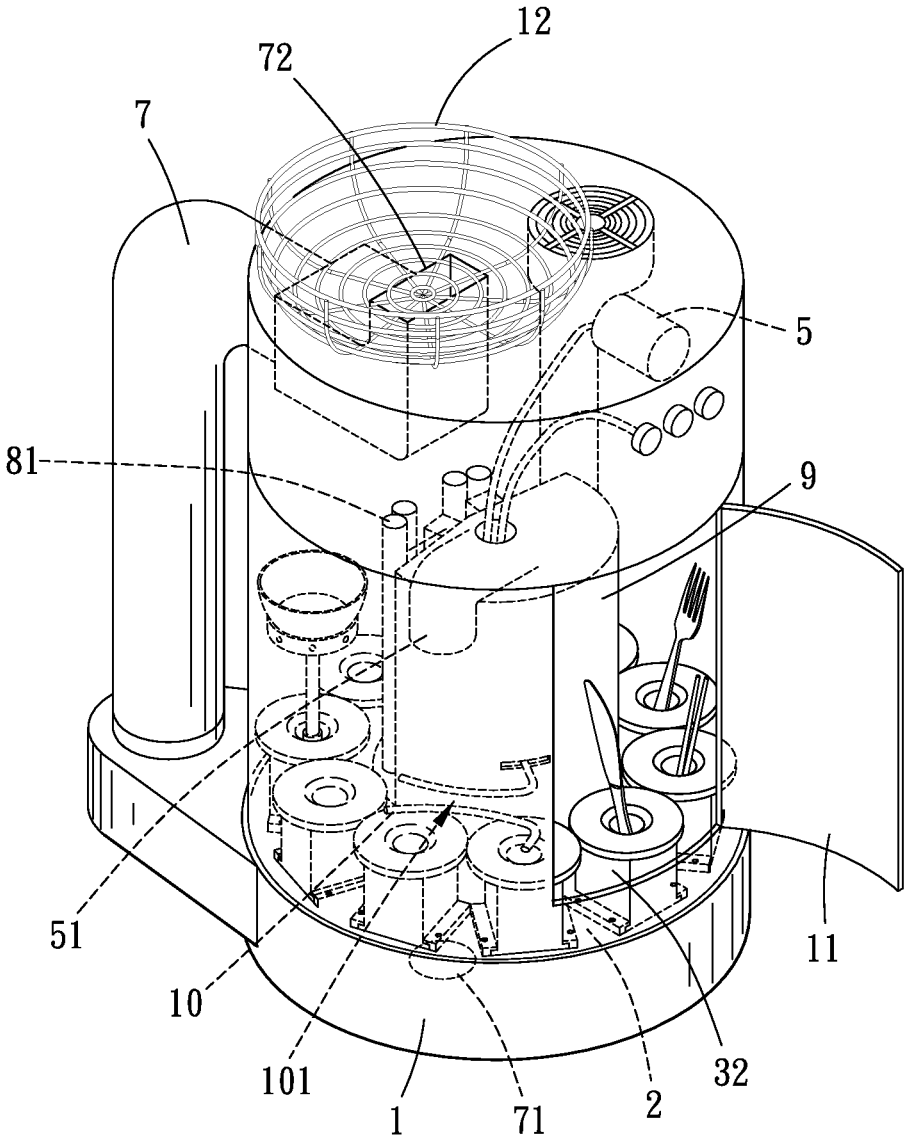
FIG. 11 is a stereogram showing a fourth embodiment of the present invention.

Please refer to FIG. 11. In a forth embodiment of the present invention, a basket 12 is attached to the shell 1. The basket 12 is located on the outlet 72 of the air extractor 7. Thus, tableware or similar articles may be placed in the basket 12 for being kept warm. Energy efficiency is then further increased.

What is claimed is:

1. A tableware sterilizing and drying apparatus, comprising:

a shell, defining a chamber and an opening communicating with the chamber;

a base plate, rotatably disposed in the shell, the base plate being located in the chamber, the base plate being able to rotate about a main axis;

plural frames, disposed on an annular periphery area of the base plate, the frames revolving about the main axis when the base plate rotates, each of the frames comprising a rotatable member, the rotatable members being able to rotate about central axes thereof respectively, each of the central axes being parallel to the main axis, each of the rotatable members having a rotation wheel perpendicular to the central axis thereof;

a fixation wheel, mounted to the shell, the fixation wheel being perpendicular to the main axis, an annular periphery of the fixation wheel being formed with a smooth section and a driving section, the rotation wheels revolving about the periphery of the fixation wheel, the fixation wheel contacting the rotation wheels in a rolling manner when the rotation wheels move passing by the driving section, the fixation wheel being unable to drive the rotation wheels to rotate when the rotation wheels move passing by the smooth section, the smooth section facing the opening;

a baking device, mounted to the shell, the baking device being used for heating air and sending air into the chamber;

a power device, mounted to the shell, the power device being used for driving the base plate to rotate.

2. The tableware sterilizing and drying apparatus of claim 1, wherein the rotation wheels are formed with teeth, the driving section of the fixation wheel is formed with teeth, the smooth section of the fixation wheel is formed without tooth, and the driving section drives the rotation wheels to rotate by tooth engagement.

3. The tableware sterilizing and drying apparatus of claim 2, wherein in each of the frames:

the frame comprises said rotatable member, a holder, and an elastic member, the holder is slidably disposed on the base plate, the holder is able to slide along a radial direction of the base plate between a first position and a second position, the second position is away from the main axis with respect to the first position, the elastic member exerts an elastic force on the holder, so that the holder is generally located at the first position, and the rotatable member is rotatably disposed on the holder.

4. The tableware sterilizing and drying apparatus of claim 3, wherein tag layers are disposed on the holders of the frames respectively.

5. The tableware sterilizing and drying apparatus of claim 1, wherein each of the rotatable members is formed with a vertical groove.

6. The tableware sterilizing and drying apparatus of claim 1, wherein the shell has a cover which selectively covers the opening.

7. The tableware sterilizing and drying apparatus of claim 1, wherein the tableware sterilizing and drying apparatus further comprises a sterilizing device, the sterilizing device comprises an ultraviolet lamp, the ultraviolet lamp is firmly disposed in the shell, the ultraviolet lamp is located above the base plate, and the frames are annularly arranged around the ultraviolet lamp.

8. The tableware sterilizing and drying apparatus of claim 2, wherein the tableware sterilizing and drying apparatus further comprises a sterilizing device, the sterilizing device comprises an ultraviolet lamp, the ultraviolet lamp is firmly disposed in the shell, the ultraviolet lamp is located above the base plate, and the frames are annularly arranged around the ultraviolet lamp.

9. The tableware sterilizing and drying apparatus of claim 3, wherein the tableware sterilizing and drying apparatus further comprises a sterilizing device, the sterilizing device comprises an ultraviolet lamp, the ultraviolet lamp is firmly disposed in the shell, the ultraviolet lamp is located above the base plate, and the frames are annularly arranged around the ultraviolet lamp.

10. The tableware sterilizing and drying apparatus of claim 7, wherein the tableware sterilizing and drying apparatus further comprises a shelter, the shelter is mounted to the shell, and the shelter is located between the ultraviolet lamp and the opening.

11. The tableware sterilizing and drying apparatus of claim 8, wherein the tableware sterilizing and drying apparatus further comprises a shelter, the shelter is mounted to the shell, and the shelter is located between the ultraviolet lamp and the opening.

12. The tableware sterilizing and drying apparatus of claim 9, wherein the tableware sterilizing and drying apparatus further comprises a shelter, the shelter is mounted to the shell, and the shelter is located between the ultraviolet lamp and the opening.

13. The tableware sterilizing and drying apparatus of claim 10, wherein the tableware sterilizing and drying apparatus further comprises two restraining rods, one of the restraining rods is mounted to the shelter, the other one of the restraining rods is mounted to the shell, a channel is defined by the restraining rods, and the channel is located above one of the rotatable member.

14. The tableware sterilizing and drying apparatus of claim 11, wherein the tableware sterilizing and drying apparatus further comprises two restraining rods, one of the restraining rods is mounted to the shelter, the other one of the restraining rods is mounted to the shell, a channel is defined by the restraining rods, and the channel is located above one of the rotatable member.

15. The tableware sterilizing and drying apparatus of claim 12, wherein the tableware sterilizing and drying apparatus further comprises two restraining rods, one of the restraining rods is mounted to the shelter, the other one of the restraining rods is mounted to the shell, a channel is defined by the restraining rods, and the channel is located above one of the rotatable member.

16. The tableware sterilizing and drying apparatus of claim 1, wherein the tableware sterilizing and drying apparatus further comprises an air extractor, the air extractor is used for drawing air out from the chamber, the baking device has an outlet located vertically above one of the rotatable members, the air extractor has an inlet located vertically under the outlet of the baking device, and a high temperature channel is defined between the outlet of the baking device and the inlet of the air extractor.

17. The tableware sterilizing and drying apparatus of claim 13, wherein the tableware sterilizing and drying apparatus further comprises an air extractor, the air extractor is used for drawing air out from the chamber, the baking device has an outlet located vertically above one of the rotatable members, the air extractor has an inlet located vertically under the outlet of the baking device, and a high temperature channel is defined between the outlet of the baking device and the inlet of the air extractor.

18. The tableware sterilizing and drying apparatus of claim 14, wherein the tableware sterilizing and drying apparatus further comprises an air extractor, the air extractor is used for drawing air out from the chamber, the baking device has an outlet located vertically above one of the rotatable members, the air extractor has an inlet located vertically under the outlet of the baking device, and a high temperature channel is defined between the outlet of the baking device and the inlet of the air extractor.

19. The tableware sterilizing and drying apparatus of claim 15, wherein the tableware sterilizing and drying apparatus further comprises an air extractor, the air extractor is used for drawing air out from the chamber, the baking device has an outlet located vertically above one of the rotatable members, the air extractor has an inlet located vertically under the outlet of the baking device, and a high temperature channel is defined between the outlet of the baking device and the inlet of the air extractor.

* * * * *